United States Patent [19]

Balas et al.

[11] 4,067,576

[45] Jan. 10, 1978

[54] APPARATUS FOR PLAYING A GAME

[76] Inventors: Salman Heskel Balas, Little Linden, Montacute Gardens, Tunbridge Wells, Kent TN4 8HG; Clifton Quinton Keiller, Little Brook House, Ragged Dog Lane, Waldron, Sussex, both of England

[21] Appl. No.: 682,909

[22] Filed: May 4, 1976

[30] Foreign Application Priority Data

| | | |
|---|---|---|
| May 12, 1975 | United Kingdom | 19851/75 |
| July 3, 1975 | United Kingdom | 28029/75 |
| July 21, 1975 | United Kingdom | 30398/75 |

[51] Int. Cl.[2] ..... A63F 3/00

[52] U.S. Cl. ..... 273/282 GA; 273/1 R; 273/120 R; 273/123 R; 273/236 GA; 273/273

[58] Field of Search ..... 273/130 R, 131 B, 135 R, 273/135 B, 134 GA, 136 E, 139, 1 R, 130 D, 134 G, 120 R, 123 R, 124 R

[56] References Cited

U.S. PATENT DOCUMENTS

| | | | |
|---|---|---|---|
| 1,755,730 | 4/1930 | Gosser | 273/134 G |
| 2,219,546 | 10/1940 | Petersen | 273/131 B |
| 2,463,425 | 3/1949 | Rendel | 273/130 R |
| 3,181,867 | 5/1965 | Dreyer | 273/136 E |
| 3,409,302 | 11/1968 | Harrison | 273/139 |
| 3,488,052 | 1/1970 | Weisbecker | 273/1 R |
| 3,501,151 | 3/1970 | Ketchum | 273/130 D |
| 3,705,727 | 12/1972 | Breslow | 273/135 B |

*Primary Examiner*—William H. Grieb
*Assistant Examiner*—Harry G. Strappello
*Attorney, Agent, or Firm*—Diller, Brown, Ramik & Wight

[57] ABSTRACT

Apparatus for playing a game utilizing a plurality of balls and a playing device, the device comprising an upper board having spaced openings to receive one of the balls, a lower board positioned vertically below the upper board, ball receiving positions formed by projections depending from the upper board in co-operation with projections upstanding on the lower board, the projections of the upper and lower boards being provided to permit a rejected ball to pass from the vicinity of a ball receiving position to a collecting tray, and the projections on the upper and lower boards, or other projections, serving to prevent a rejected ball from entering another ball receiving position.

24 Claims, 11 Drawing Figures

APPARATUS FOR PLAYING A GAME

This invention relates to apparatus for playing a game of skill and intellect which involves memorizing moves made by the players taking part in the game.

It is among the objects of the present invention to provide apparatus for playing a game which is simple and relatively cheap to manufacture whilst, at the same time, provides an interesting and exciting game capable of being easily and quickly mastered by both young and old players.

According to the present invention, there is provided apparatus for playing a game, which comprises in combination a plurality of spherical playing pieces in the form of balls and a playing device, wherein the playing device consists of an upper board having a plurality of spaced openings of a size through which a ball may pass, a lower board positioned vertically below the upper board, ball receiving positions corresponding to at least some of the openings in the upper board and provided in part by the upper board and in part by the lower board, means permitting a rejected ball to pass from the vicinity of a ball receiving position, and means provided at or adjacent each ball receiving position to prevent a rejected ball from entering another ball receiving position.

Preferably, the number of ball receiving positions correspond to the number of openings in the upper board.

A rejected ball is one which, during the course of playing a game, is prevented from entering a ball receiving position by a ball which already occupies that position.

Figure 1:
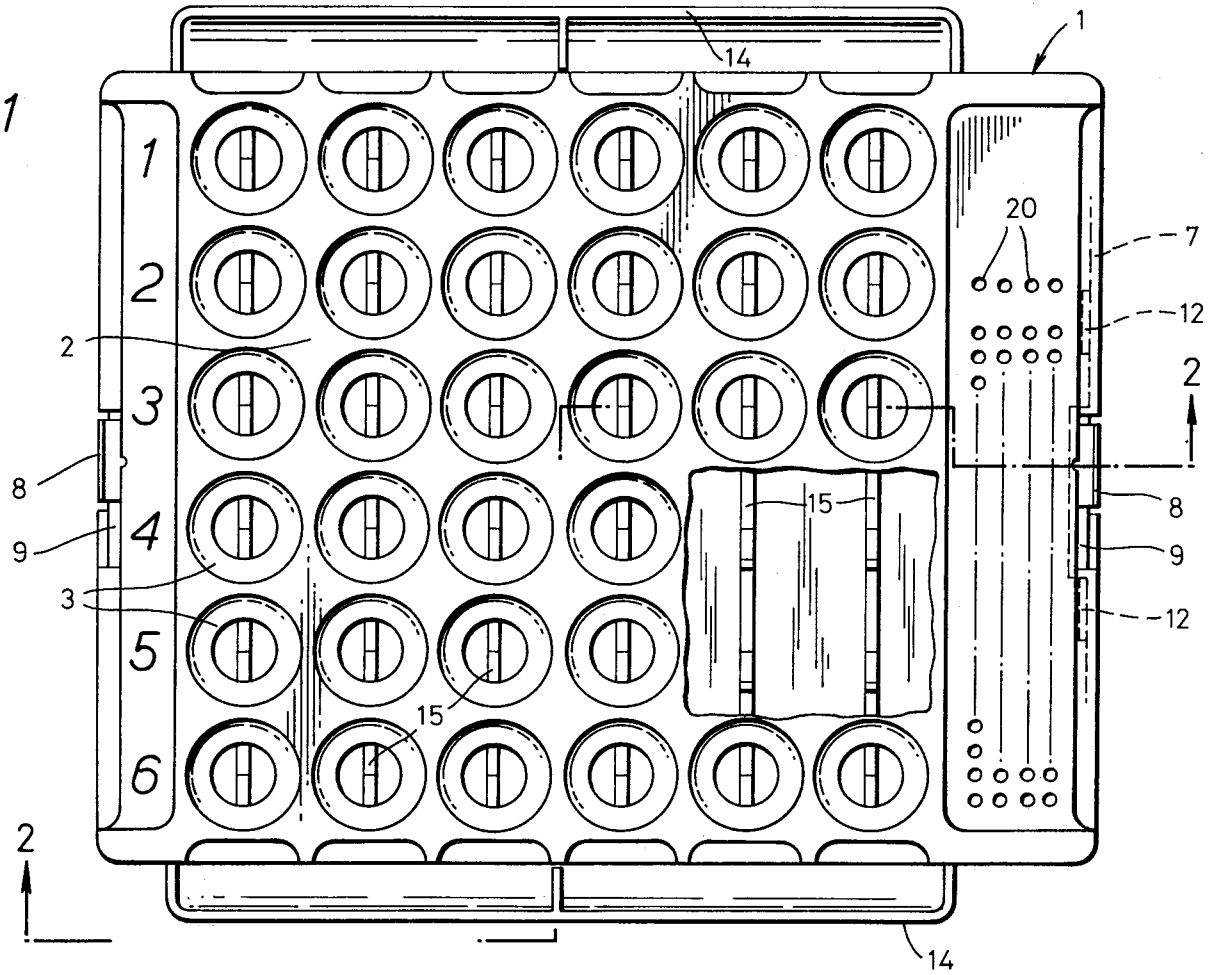
Figure 2:
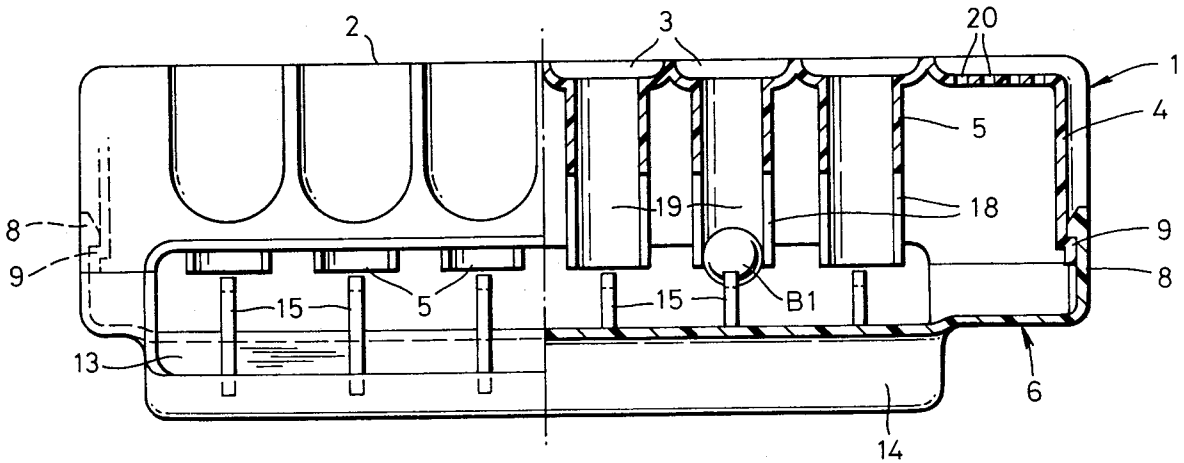
Figure 3:
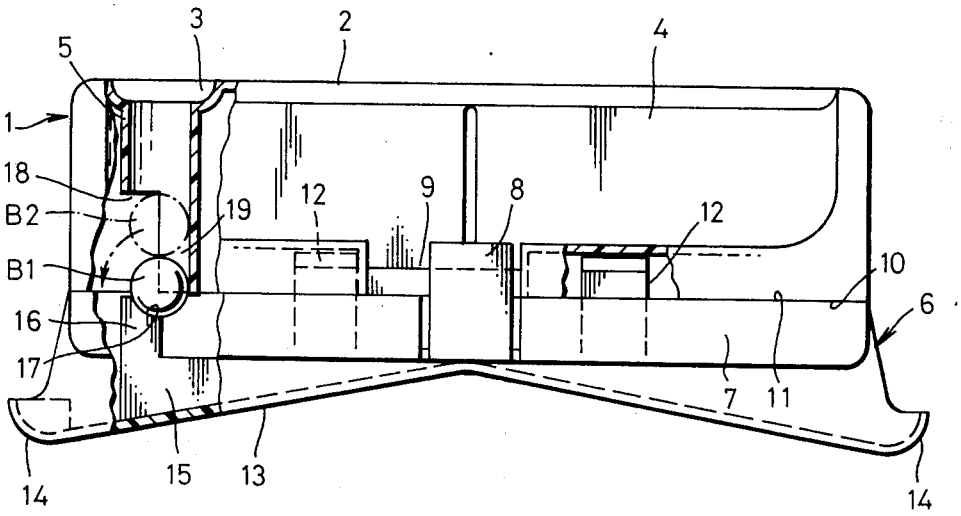
Figure 4:
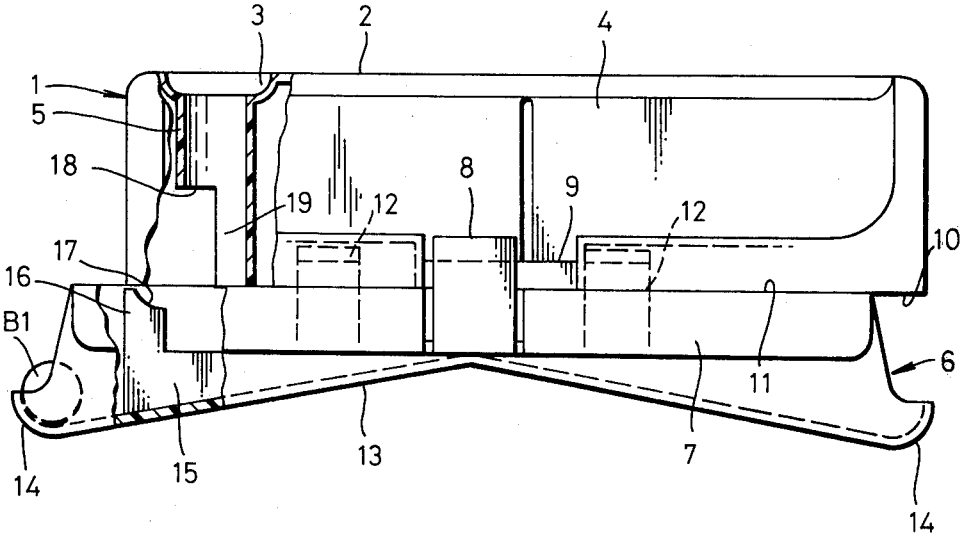
Figure 5:
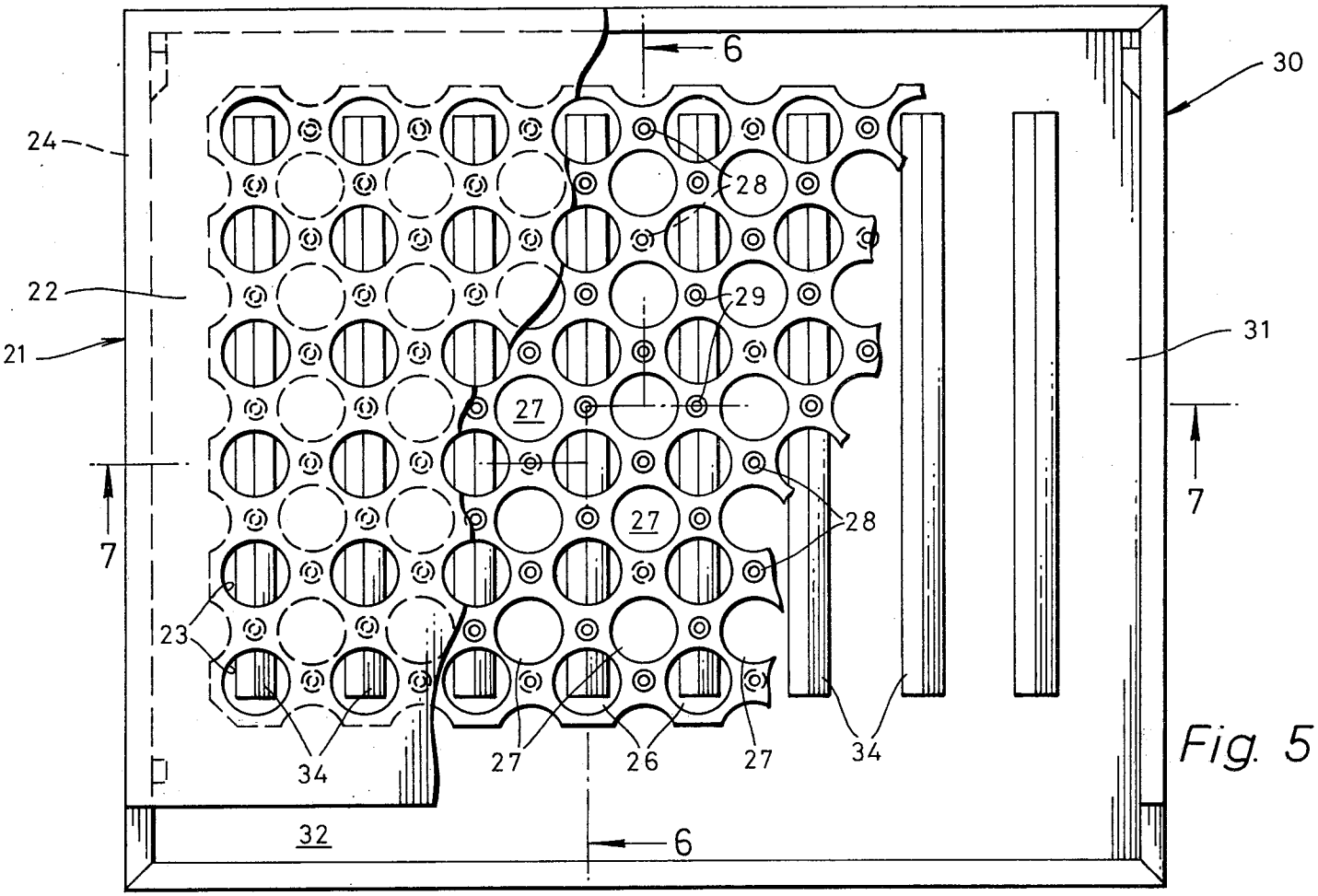
Figure 6:
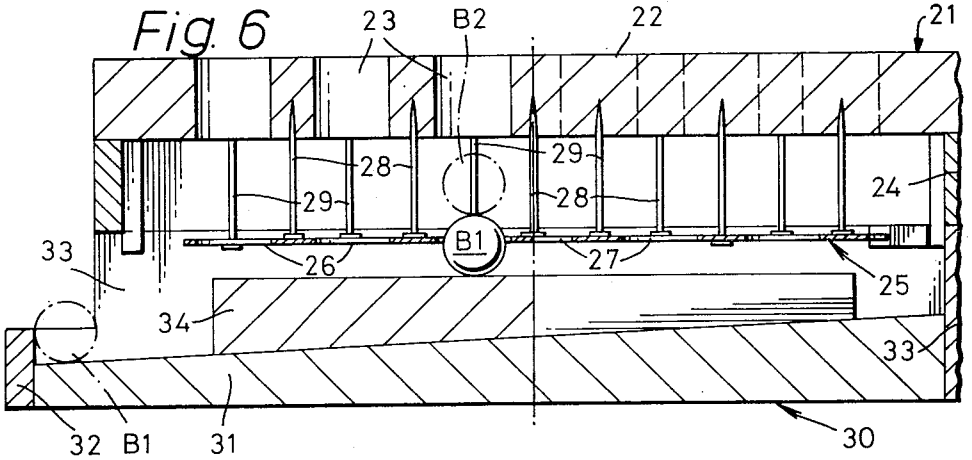
Figure 7:
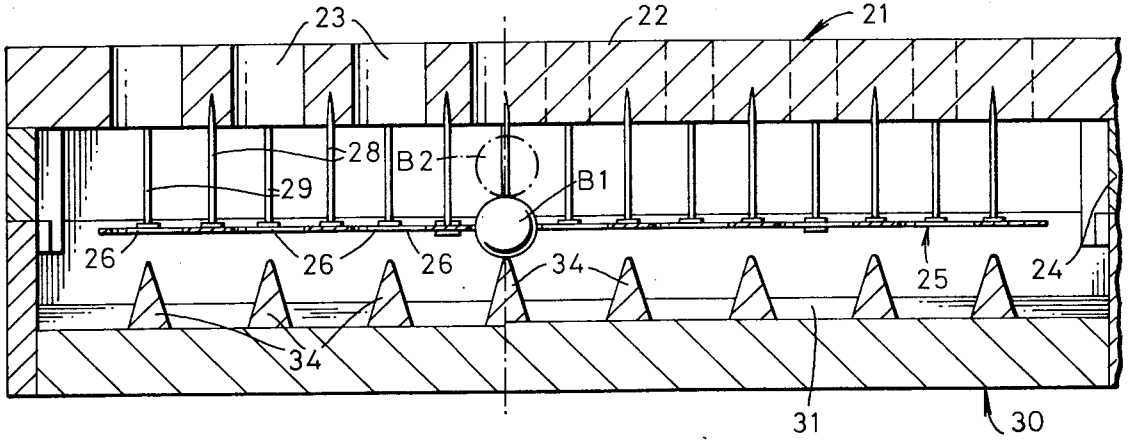
Figure 8:
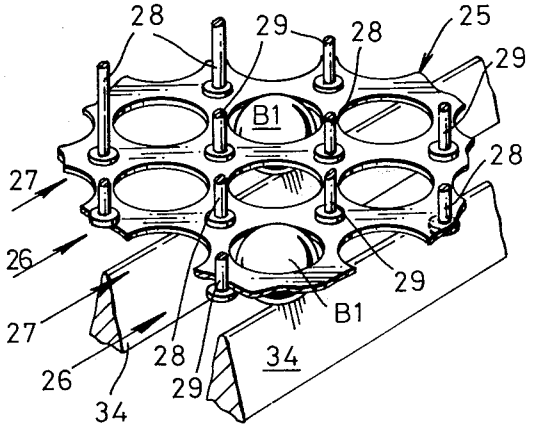
Figure 9:
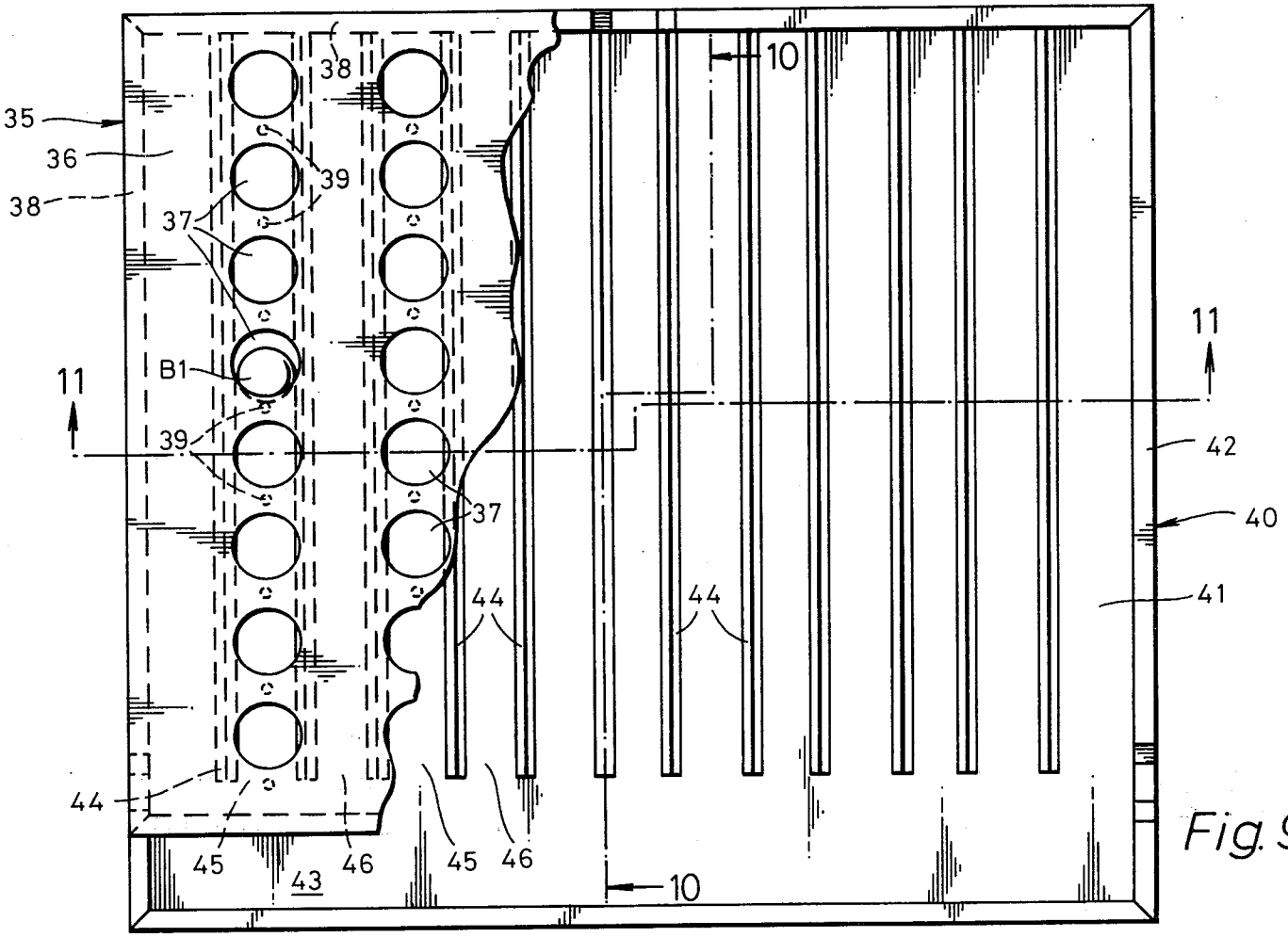
Figure 10:
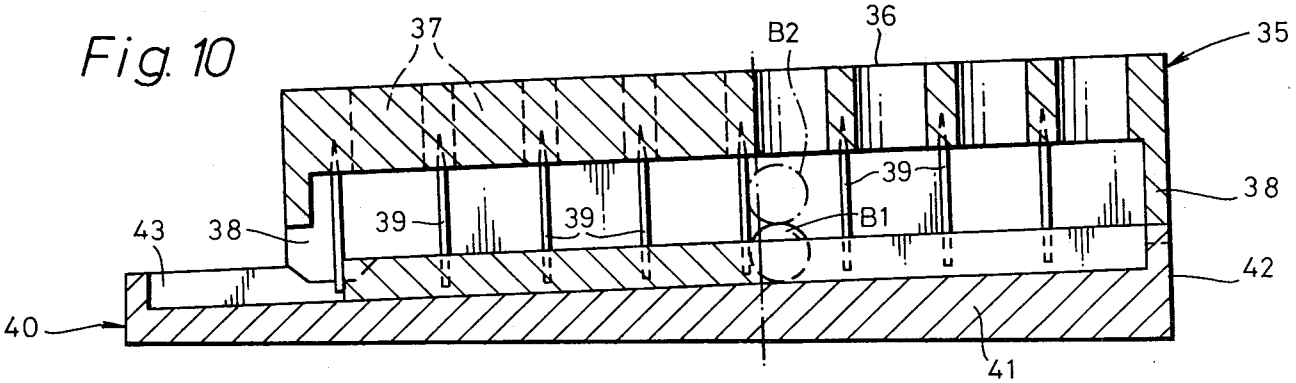
Figure 11:
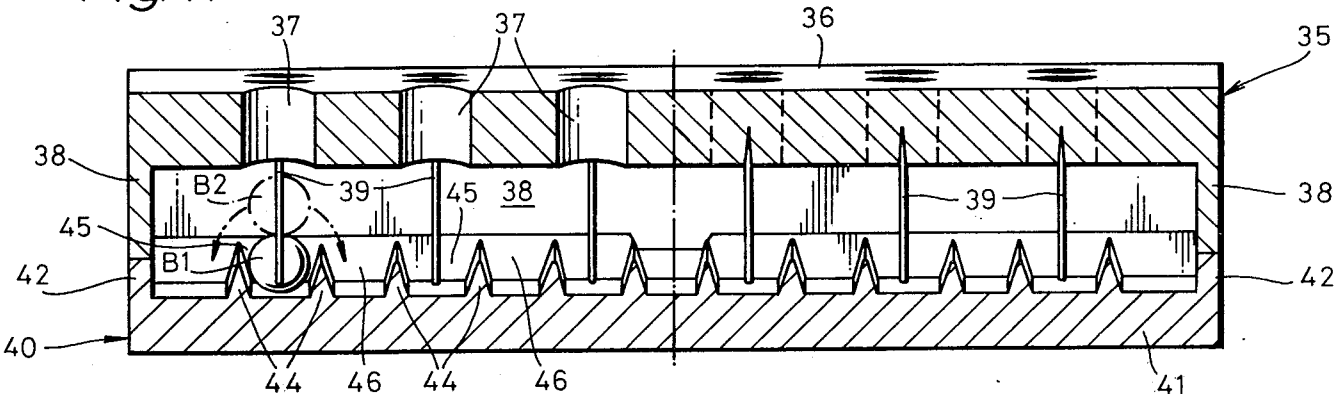

The invention is illustrated by way of example in the accompanying drawings in which, FIG. 1 is a plan view, partially cut away, of one device according to the invention, FIG. 2 is a part front elevation and part section on the line 2—2 of FIG. 1, FIG. 3 is an end elevation, partly in section, of the device of FIGS. 1 and 2 in its normal playing position, FIG. 4 is an end elevation corresponding to FIG. 3 showing the device in a ball-release position, FIG. 5 is a plan view of a modified embodiment of the device, parts thereof being cut away for clarity, FIG. 6 is a section on the line 6—6 of FIG. 5, FIG. 7 is a section on the line 7—7 of FIG. 5, FIG. 8 is a scrap perspective view of the device of FIGS. 5 to 7, FIG. 9 is a plan view of a further modified embodiment of the device, part thereof being cut away for clarity, FIG. 10 is a section on the line 10—10 of FIG. 9, and FIG. 11 is a section on the line 11—11 of FIG. 9.

Apparatus for playing a game comprises a plurality of playing pieces in the form of balls which may be divided into differently coloured, or differently marked, sets, one set being provided for each player, and a playing device which is common to all the players.

Referring to FIGS. 1 to 4 of the drawings, one embodiment of the playing device comprises an upper board 1 having a flat upper surface 2 formed with a plurality of openings 3 which are arranged in rows and are of a size to permit the passage therethrough of a ball. The board 1 also has downwardly depending front, rear and end walls 4. Each opening 3 has formed in continuation thereof a downwardly depending tube 5.

The device further includes a lower board 6 having upstanding end walls 7 each of which includes a hook-like resilient retainer element 8 which co-acts with a shoulder 9 formed on the end wall 4 of the upper board 1 and serves, normally, to hold the upper and lower boards together. As can be seen, particularly from FIGS. 3 and 4, the upper and lower boards are formed, in the area of the end walls 4 and 7, with co-acting flat surfaces indicated respectively at 10 and 11, these surfaces, together with the connections between the elements 8 and the shoulders 9, being such as to enable the upper board 1 to be slid to a limited extent rearwardly, relative to the lower board 6, from the normal playing position of the device as shown in FIG. 3, to the ball-release position shown in FIG. 4. This operation is further facilitated by upstanding guide blocks 12 provided on the lower board 6 to co-act with the upper board 1.

The lower board 6 also includes a base wall 13, the upper surface at least of which is inclined to the horizontal. In this particular embodiment, the base wall 13 is inclined in two opposite directions from the centre as can be seen in FIGS. 3 and 4. The lower board 6 further includes front and rear ball collecting trays or troughs 14 which communicate with, and form extensions of, the inclined base wall portions 13.

Fixed to the base wall 13, in a position which is central relative to each fore and aft row of openings 2, is a vertically disposed wall 15. Each wall 15 is formed with spaced upstanding ball-engaging projections 16. Each projection 16 co-acts with the lower end of the tube 5 associated with a correspondingly positioned opening 3. As can be seen, particularly from FIG. 4, each projection 16 extends over a distance corresponding to approximately the radius of the tube 5, the innermost portion thereof having a arcuate cut-out 17. As can be seen from FIG. 4, this presents a cradle-like element for a ball B1 which, together with the tube 5, provides a ball receiving position.

In playing a game, if another ball B2 is placed in the same opening 3, it is rejected. In order to facilitate rejection of the ball B2, and passage thereof from the vicinity of the ball receiving position, one half of the cross-section of the tube 5 is cut-away at 18 so that the ball B2 is free to roll off the ball B1 and to fall onto the inclined base wall 13 from which it rolls between the walls 15 into the collecting tray or trough 14.

When a ball is rejected, it is of course essential that it will not fall, or roll, into an unoccupied ball receiving position. This is prevented by the arcuate portions 19 of the lower ends of the tube 5. In this respect, it will be seen that the arcuate portions 19 provide convex obstructions which face upstream of the direction of movement of rejected balls towards the troughs 14.

At the end of a game, the retained ball or balls B1 is or are permitted to fall onto the base wall 13 and to roll into the trough or troughs 14 by moving the upper board 1 relative to the lower board 6 in the manner hereinbefore described.

It will be appreciated that the length of each tube 5 is such that a player cannot normally see whether or not a ball receiving position is occupied.

In order to adapt the device for use in a game where two or more balls are held in a ball receiving position, it will be obvious that the front edge of each, or some, of the projections 16 could be extended upwards and the length of the cut-out parts 18 of the tubes 5 correspondingly increased.

The upper board 1 may also include a plurality of rows of holes 20 which can be used, in combination with suitable pegs or markers, to provide a scoring board.

In playing a game, a ball is dropped through a selected opening 3 and lodges in the corresponding ball receiving position provided by a projecting element 16 and the lower end of its co-acting tube 5. If, during play, another ball is dropped through the same opening 3, then such ball will be deflected by the occupying ball and will fall onto the inclined base wall 13 and roll into the trough 14 where it can be retrieved by the player. In the latter respect, as indicated above, the rejected ball is prevented from entering an unoccupied ball receiving position by the arcuate portions 19 of the tubes 5.

In the alternative embodiment shown in FIGS. 5 to 8 of the drawings, the playing device comprises an upper board 21 having a flat upper surface 22 formed with a plurality of openings 23 arranged in rows, the openings being of a size to allow the passage therethrough of a ball. The upper board 21 also has downwardly depending front, rear and end walls 24.

Spaced from the underside of the flat surface 22 of the board 1 is an intermediate board 25 having a series of spaced rows of ball receiving holes 26 which correspond to the positions of the openings 23 in the flat surface 22. The intermediate board 25 is also formed with a series of spaced rows of ball rejection holes 27 arranged alternately with the rows of ball receiving holes 26.

The intermediate board 25 is fixed to, and held in spaced relationship with, the underside of the flat surface 23 by means of pins 28 positioned in the spaces between the holes 27 of each row. Furthermore, pins 29 are fixed to the underside of the flat surface 22 and depend downwardly to the intermediate board 25 at positions between the ball receiving holes 26 of each row. Thus, as can be seen particularly from FIG. 5, the pins 28 and 29 are arranged alternately with the holes 26 and 27 both in a fore and aft direction and in an end to end direction.

The device also includes a lower board 30 having a base wall 31 the upper surface of which is inclined from the rear to the front of the device, a ball collecting tray or trough 32 being positioned at the front of the device which communicates with, and forms an extension of, the inclined surface of the base wall 31.

The board 30 also has upstanding rear and end walls 33 on which the upper board 21 rests. In addition, a plurality of spaced ball supporting walls 34 are provided on the inclined surface of the base wall 31, the walls 34 being positioned below, and in alignment with, the fore and aft rows of ball receiving holes 26. In a modification, the walls 34 could be replaced by rows of upstanding pegs or pins arranged centrally of each ball receiving hole 26.

In playing a game, a ball B1 is dropped into a selected opening 23 and drops into the corresponding hole 26 in the intermediate board 25 where it is retained by engagement with the co-acting ball supporting wall 34. Thus, the hole 26 and the wall 34 in combination provide a ball receiving position.

If another ball B2 is dropped into the same opening 23, it is rejected by rolling off the ball B1 occupying that ball receiving position. The ball B2 will then fall through one of the adjacent ball rejection holes 27 onto the inclined base surface of the wall 31 and roll between two adjacent walls 34 into the collecting trough 32 from which it can be retrieved by the player.

It is essential that the rejected ball should not roll into an unoccupied ball receiving position. This is prevented by the positioning of the pins 28 and 29. Thus, two pins 28 and two pins 29 occupy diametrically opposite positions relative to each ball receiving hole 26 and thereby force the rejected ball to roll diagonally into one of the four ball rejection holes 27 adjacent that hole 26. The holes 27 are also arranged in diametrically opposite positions relative to a hole 26 but these positions are angularly offset relative to the positions of the pins 28 and 29.

On completion of a game, the upper board is raised and thereby releases the or each ball B1 from its or their ball receiving position or positions so that they roll into the collecting trough 32 in the manner hereinbefore described with reference to the rejected ball B2. In a modification, the upper and lower boards 21 and 30 could be hingedly interconnected at their rear walls 24 and 33. In this case, pivoting of the upper board relative to the lower board will serve to release the balls.

In the further alternative embodiment shown in FIGS. 9 to 11 of the drawings, the playing device comprises an upper board 35 having a flat surface 36 formed with a plurality of openings 37 arranged in rows, the openings 37 being of a size to allow the passage therethrough of a ball. The board 35 also has downwardly depending rear and end walls 38. In each space between adjacent openings 37 of each fore and aft row of openings 37 a pin 39 is fixed to the underside of the flat surface 36 to depend downwardly therefrom.

The device further includes a lower board 40 having a base wall 41 the upper surface of which is inclined from the rear to the front thereof. The board 40 also has upstanding rear and end walls 42 on which the walls 38 of the upper board 35 rest.

At its front end, the lower board 40 is provided with a ball collecting tray or trough 43 which is in communication with, and forms an extension of, the inclined surface of the base wall 41.

Formed on, or provided on, the base wall 41 is a series of spaced upstanding guide walls 44 which extend fore and aft of the board 40. The guide walls 44 are positioned to present, alternately, a ball receiving channel 45 and a ball rejection channel 46. The channels 45 are positioned immediately below the respective rows of openings 37 and the channels 46 are in positions corresponding to the spaces between the rows of openings 37. As can be seen, particularly in FIG. 11, the pins 39 extend downwardly into their co-acting ball receiving channels 45.

In playing a game, a ball B1 is dropped into a selected opening 37 where it falls into the corresponding ball receiving channel 45 between two adjacent pins 39. Thus, in this embodiment, two adjacent guide walls 44 and two adjacent pins 39 provide a ball receiving position. If, during play, another ball B2 is dropped into the same opening 37, then such ball will be deflected by the occupying ball B1 and will fall into one or other of the ball rejection channels 46 positioned on either side of the ball receiving channel in question. The rejected ball B2 will then roll, guided by the walls 44, down the rejection channel 46 into the ball collecting tray or trough 43. Here again, the rejected ball must be prevented from entering an unoccupied ball receiving position. The means for ensuring this comprise the pins 39 of that ball receiving position and the guide walls 44.

At the end of a game, any balls held in the ball receiving positions are allowed to roll down the ball receiving channels 45 into the collecting trough 43 by raising the upper board 35 and thereby moving the pins 39 out of the channels 45. Alternatively, the upper and lower boards may be hingedly connected together and release effected by pivotally moving the upper board relative to the lower board.

Bearing in mind, as mentioned hereinbefore, that the apparatus is used to play a game in which a player relies on his memory, the surface of the upper board may be marked in various ways to make it more or less difficult to memorise the moves made, or holes selected, by the players. Thus, the holes in the upper board may be marked with consecutive numbers, or with a random arrangement of numbers, or by other indicia or colours arranged in different ways, for example transverse rows, diagonal rows, in blocks or in any other manner.

In the latter respect, provision may be made for the flat surface of the upper board to receive replaceable cards having different arrangements of markings and/or colours in order to vary the game and/or to present varying degrees of difficulty in playing a game.

It will be appreciated that there is no limitation on the number of openings provided in the upper board, or on the number of balls used for playing a game.

Numerous different forms of game can be played. For example, each player may have a predetermined number of balls and the winner is the first player to lodge all his balls in the ball-receiving positions, it being understood that any rejected balls are returned to the player for re-use. Alternatively, each player may have a predetermined number of balls each of which is used only once, the winner being the player who has the smallest number of rejected balls. In another alternative, the ball-receiving positions are each given a value which is normally hidden from view, and scoring is based on those values. In this respect, it will be obvious that numerous other forms of game may be played with the apparatus.

Of the embodiments hereinbefore described, the embodiment of FIGS. 1 to 4 is moulded from a synthetic plastics material, and the other two embodiments are made from timber with metal pins. It will be obvious that the invention is not in any way limited in this respect. Thus, the playing device may be made of a plastics material, metal, wood, cardboard or the like, or any combination of these materials.

We claim:

1. Apparatus for playing a game, comprising in combination a plurality of spherical playing pieces in the form of balls and a playing device, said playing device comprising an upper board having a plurality of spaced openings of a size through which a ball may pass, a lower board positioned vertically below said upper board, ball receiving positions for retaining at least one of said balls and corresponding to at least some of said openings in said upper board, said ball receiving positions being provided by means depending from said upper board co-acting with means upstanding on said lower board, means permitting a rejected ball which is a ball prevented from entering a ball receiving position by a ball which already occupies such position to pass from the vicinity of said ball receiving position, and means provided in the region of said ball receiving position to prevent said rejected ball from entering another ball receiving position.

2. Apparatus as claimed in claim 1, in which said upper board has a flat upper surface having at least two peripheral walls depending downwardly therefrom, and said lower board has a base wall having at least two upstanding peripheral walls co-acting with said walls of said upper board, the upper surface at least of said base wall being inclined to the horizontal.

3. Apparatus as claimed in claim 2, wherein said lower board has at least one ball collecting tray or trough in communication with said inclined surface of said base wall.

4. Apparatus as claimed in claim 3, in which said ball collecting tray or trough is formed as an extension of said inclined surface of said base wall.

5. Apparatus as claimed in claim 1, wherein each of said openings in said upper board has a downwardly extending tube formed in continuation thereof, and each of said tubes has associated with the lower and free end thereof an upstanding projection provided on said lower board.

6. Apparatus as claimed in claim 5, wherein said upstanding projection extends over approximately one half of the diameter of said tube and has an arcuate cut-out portion which, in combination with the inner periphery of said tube, provides a ball receiving position.

7. Apparatus as claimed in claim 6, in which one half of the cross-sectional area of said tube is cut away at the lower end thereof to facilitate rejection and passage of a ball away from said ball receiving position.

8. Apparatus as claimed in claim 7, wherein the remaining half of the cross-sectional area of said tube provides said means for preventing a rejected ball from entering a ball receiving position.

9. Apparatus as claimed in claim 8, wherein said upper and lower boards are interconnected so as to be capable of limited relative sliding movement.

10. Apparatus as claimed in claim 1, including an intermediate board depending from said upper board and having ball receiving holes arranged in positions corresponding to those of said openings in said upper board.

11. Apparatus as claimed in claim 10, including upstanding projections formed on said lower board immediately below said ball receiving holes, said projections, in co-operation with said ball receiving holes, providing said ball receiving positions.

12. Apparatus as claimed in claim 11, in which said upstanding projections are in the form of continuous strips.

13. Apparatus as claimed in claim 12, in which said intermediate board includes ball rejection holes interspaced with said ball receiving holes.

14. Apparatus as claimed in claim 13, including pins extending between said upper board and said intermediate board and interspaced with said ball rejection and said ball receiving holes, said pins providing said means to prevent a rejected ball from entering another ball receiving position.

15. Apparatus as claimed in claim 14, wherein said upper and said lower boards are hingedly interconnected.

16. Apparatus for playing a game, comprising in combination a plurality of spherical playing pieces in the form of balls and a playing device, said playing device comprising an upper board having a plurality of spaced openings of a size through which a ball may pass, a lower board positioned vertically below said upper board, ball receiving positions for retaining at least one of said balls and corresponding to at least some of said openings in said upper board, means permitting a rejected ball which is a ball prevented from entering a ball receiving position by a ball which already occupies such position to pass from the vicinity of said ball receiving position, means provided in the region of said ball receiving position to prevent said rejected ball from entering another ball receiving position, upstanding projections formed on said lower board immediately below said ball receiving holes, and said projections in co-operation with said ball receiving openings providing said ball receiving positions.

17. Apparatus as claimed in claim 16, in which said upstanding projections are in the form of continuous strips.

18. Apparatus as claimed in claim 17, in which said intermediate board includes ball rejection holes interspaced with said ball receiving holes.

19. Apparatus as claimed in claim 18, including pins extending between said upper board and said intermediate board and interspaced with said ball rejection and said ball receiving holes, said pins providing said means to prevent a rejected ball from entering another ball receiving position.

20. Apparatus as claimed in claim 19, wherein said upper and said lower boards are hingedly interconnected.

21. Apparatus for playing a game, comprising in combination a plurality of spherical playing pieces in the form of balls and a playing device, said playing device comprising an upper board having a plurality of spaced openings of a size through which a ball may pass, a lower board positioned vertically below said upper board, ball receiving positions for retaining at least one of said balls and corresponding to at least some of said openings in said upper board, means permitting a rejected ball which is a ball prevented from entering a ball receiving position by a ball which already occupies such position to pass from the vicinity of said ball receiving position, means provided in the region of said ball receiving position to prevent said rejected ball from entering another ball receiving position, said upper board being provided with downwardly depending pins interspaced with said openings, and said lower board being provided with spaced parallel upstanding projections to provide, alternately, ball receiving channels and ball rejection channels.

22. Apparatus as claimed in claim 21, in which said ball receiving channels are in alignment with said openings in said upper board and said depending pins project into said channels so that a pair of adjacent pins, in co-operation with said upstanding projections of said ball receiving channel, provide a ball receiving position.

23. Apparatus as claimed in claim 22, in which said upstanding projections on either side of, and forming, said ball rejection channels provide said means for preventing a rejected ball from entering another ball receiving position.

24. Apparatus as claimed in claim 23, wherein said upper and said lower boards are hingedly interconnected.

* * * * *